US006766128B2

(12) United States Patent
Jaskowiak

(10) Patent No.: US 6,766,128 B2
(45) Date of Patent: Jul. 20, 2004

(54) PRECISION PARTIALLY CYLINDRICAL WEB GUIDE MEMBER AND IMPROVED MANUFACTURING PROCESS FOR MAKING THE SAME

(75) Inventor: Timothy R. Jaskowiak, Webster, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/293,055

(22) Filed: Nov. 12, 2002

(65) Prior Publication Data

US 2004/0091284 A1 May 13, 2004

(51) Int. Cl.[7] ..... G03G 15/00
(52) U.S. Cl. ..... 399/164; 29/413
(58) Field of Search ..... 399/162, 163, 399/164, 165, 302, 308; 347/154, 262, 264; 198/841; 29/412, 413, 414

(56) References Cited

U.S. PATENT DOCUMENTS

| | | | | |
|---|---|---|---|---|
| 5,337,123 A | * | 8/1994 | Fisher | 399/164 |
| 5,491,538 A | | 2/1996 | Gwaltney | 355/247 |
| 5,708,924 A | | 1/1998 | Shogren et al. | 399/116 |
| 5,778,287 A | * | 7/1998 | Yu | 399/162 |

* cited by examiner

*Primary Examiner*—Robert Beatty
(74) *Attorney, Agent, or Firm*—Richard F. Spooner

(57) ABSTRACT

A precision partially cylindrical web guide member for use as a backer bar in electrophotographic printers or as a similar web guide in an apparatus with moving webs. In a novel process of the invention, multiple web guide members may be manufactured from arc segments of a tube wherein the finished radial dimensions of the web guide members are formed in a turning process. The bottom surface of the web guide member need not be machined or finished.

25 Claims, 6 Drawing Sheets

PRECISION PARTIALLY CYLINDRICAL WEB GUIDE MEMBER AND IMPROVED MANUFACTURING PROCESS FOR MAKING THE SAME

BACKGROUND OF THE INVENTION

The present invention relates generally to improved precision manufactured web, web guide members made by an improved precision manufacturing process. One embodiment of the improved manufacturing process and improved web guide members is described in relation to precision backer bars for use in electrostatographic printing systems for controlling tension and tolerances of a moving web.

Rounded web guide members are used frequently during many processes for handling or manufacturing moving webs. Examples include photographic film and paper manufacturing, paper manufacturing, rolled steel and aluminum manufacturing and any number of similar operations. Rounded web guide members are often used in such applications to provide support, tension, and directional control of the moving web. The more precise the requirements for uniform treatment of the web, the more precise the requirements for uniform straightness and curvature of the rounded web guide members.

One embodiment of an apparatus requiring extreme straightness and length-wise uniformity of web guide members occurs when such web guide members are used as backer bars within imaging-web based electrostatographic printing systems. Backer bars are commonly used in such electrostatographic printing systems to hold flexible electrostatographic imaging members in proper position with proper tension. In order to understand the function and importance of backer bars, a description of printing systems utilizing flexible imaging members follows:

Flexible electrostatographic imaging members are well known in the art. Typical electrostatographic imaging members include, for example, photoreceptors for electrophotographic imaging systems and electroreceptor such as, ionographic imaging members for electrographic imaging systems. These imaging members generally comprise at least a supporting substrate layer and at least one imaging layer comprising thermoplastic polymer matrix material. The "imaging layer" as employed herein is defined as the dielectric imaging layer of an electroreceptor or the photoconductive imaging layer of a photoreceptor. In a photoreceptor, the photoconductive imaging layer may comprise only a single photoconductive layer or a plurality of layers such as, a combination of a charge-generating layer and a charge transport layer.

Generally, in the art of electrophotography, the process of electrophotographic printing or copying is initiated by exposing an analog or digitally created image of an original document onto a substantially uniformly charged photoreceptive member. Exposing the charged photoreceptive member to a light image discharges a photoconductive surface thereon in areas corresponding to non-image areas in the original document while maintaining the charge in image areas, thereby creating an electrostatic latent image of the original document on the photoreceptive member. This latent image is subsequently developed into a visible image by depositing charged developing material onto the photoreceptive member surface such that the developing material is attracted to the charged image areas on the photoconductive surface. Thereafter, the developing material is transferred from the photoreceptive member to a receiving copy sheet or to some other image support substrate, to create an image, which may be permanently affixed to the image support substrate, thereby providing an electrophotographic reproduction of the original document. In a final step in the process, the photoconductive surface of the photoreceptive member is cleaned with a cleaning device, such as, elastomeric cleaning blade, to remove any residual developing material, which may be remaining on the surface thereof in preparation for successive imaging cycles. Electrostatographic copying and printing processes similar to those described above are well known. Analogous processes exist in other electrostatographic printing applications such as, for example, ionographic printing and reproduction where charge is deposited on a charge retentive surface in response to electronically generated or stored images.

An exemplary use of backer bars in such systems is described in U.S. Pat. No. 5,708,924, issued to Shogren et al. and hereby incorporated herein by reference. The backer bars in Shogren are mounted within a customer replaceable unit that includes a corner and support structure for supporting a photoreceptor belt while it is packaged, shipped and inserted over drive and idler rolls in a machine. The customer replaceable unit prevents a machine operator from having to handle the belt itself and provides protection from extrinsic damage. The system as described includes web guide members for tensioning the photoreceptor belt during use.

Throughout the electrostatographic imaging process described above, the photoreceptor web must be held in positions within tight tolerances. As shown and described in Shogren, many of these tolerances are maintained by web guide members such as, backer bars. Because of the requirements for tight tolerances, precision manufacturing of prior art backer bars has been an expensive and work intensive process comprising the following prior art processes:

1) Extruding an aluminum bar conforming to the general profile of the finished backing bar. An extrusion process, however, cannot yield the precision required for the part, particularly in respect to the straightness of the bar along its long dimension.

2) Machining each bar to enable the bar to be mounted to a grinding fixture and to machine holes at each end required for mounting and positioning of the finished backer bars adjacent to belt 10 within the printing system. The shape of prior art backer bars after machining is shown as bar 100 in FIG. 1. Significantly, although the rounded radius side 111 is the only side in contact with the moving imaging web in the final application, prior art processes require that both the radius surface 111 and at least one other surface be machined to great accuracy. As shown in FIG. 2, the reason is that at least one surface 112 (usually the bottom) other than the radius must be machined precisely in order that the unground raw backer bar be mounted with sufficient precision within a grinding fixture that will shape the final radius surface. If the bottom is not precisely straight, then the top radius surface will not be straight either. Since each backer bar is machined in its "free state", the costs and difficulty of this precision machining process are very significant.

3) Mounting each machined bar into a grinding fixture 113, as shown in FIG. 2. The prior art mounting fixture typically mounts 10 or more backer bars, depending upon the desired top radius.

4) Cylindrical grinding. Once the machined backer bars are mounted into grinding fixture 113, fixture 113 is placed in a cylindrical grinding apparatus comprising cylindrical grinding wheel 115 for grinding the top radius 111 of all bars mounted within the fixture to the precise radius curvature required. As noted above, straightness of the bar is largely determined by the straightness of the bottom surface since this bottom surface 112 determines the straightness of the backer bar within mounting fixture 113. The cylindrical grinding operation yields a precision-straight top surface of uniform radius dimension from the center of the mounting fixture.

5) Finishing the surface of the backer bars while placed within in the cylindrical grinder apparatus. Such finishing operation may require the additional use of various grades of grinding wheels 115 to achieve the required surface finish.

6) Anodizing the ground and finished backer bars.

The above prior art process is time consuming, labor intensive, and requires precision machining on at least two surfaces plus precision grinding. The end result is an expensive process with many opportunities yielding a significant failure rate. It would be advantageous to create precision backer bars having in a process requiring less machining and with higher yields.

SUMMARY OF THE INVENTION

One aspect of the present invention includes a process for manufacturing precision web guide members, comprising: (a) extruding a tube having a tubular body, a length dimension, an outside diameter, and an inside surface, said inside surface having radial cavities extending along the length dimension from the inside surface partially through the tubular body; (b) turning the tube to decrease the outside diameter; and (c) sizing the tube to a desired length.

Another aspect of the present invention includes a precision partially cylindrical web guide member for guiding a moving web member in an apparatus within which the web is moved, said web guide member comprising: a top surface for contacting the web comprising the outside surface of an arc segment of a cylindrical tube; and a bottom surface comprising the inside surface of the arc segment of the cylindrical tube.

Yet another aspect of the present invention includes an electrophotographic imaging system, comprising: (a) a partially cylindrical web guide member for guiding a moving web, said web guide member comprising: a top surface for contacting the web comprising the outside surface of an arc segment of a cylindrical tube; and a bottom surface comprising the inside surface of the arc segment of the cylindrical tube; and (b) a fixture for mounting the web guide member within the electrophotographic imaging system.

BRIEF DESCRIPTION OF THE DRAWINGS

The foregoing and other features of the instant invention will be apparent and easily understood from a further reading of the specification, claims and by reference to the accompanying drawings in which:

DETAILED DESCRIPTION OF THE INVENTION

Figure 1:
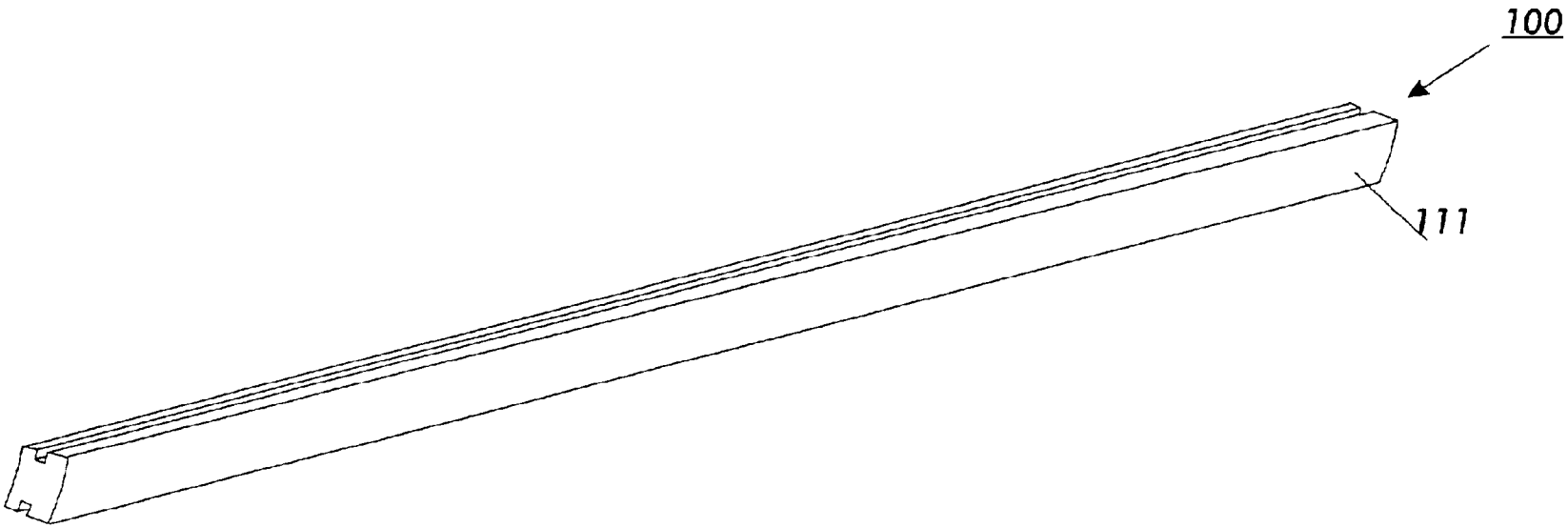
FIG. 1 PRIOR ART
FIG. 1 is an elevated perspective view of an extruded bar member of the prior art intermediate processes for making web guide members.
Figure 2:
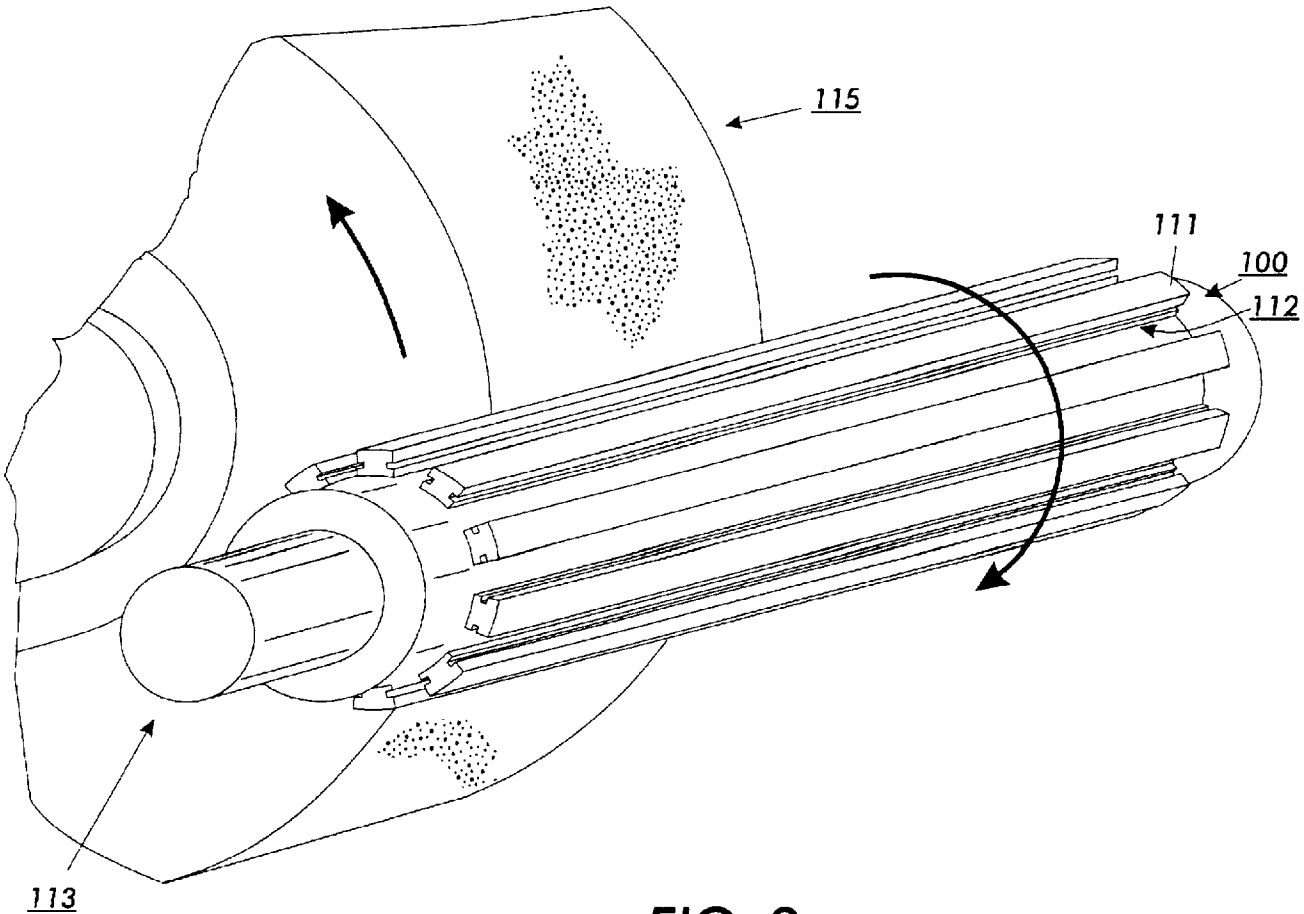
FIG. 2 PRIOR ART
FIG. 2 is an elevated perspective view of a typical grinding process used to shape and finish web turning bars of the prior art.

All references cited in this specification, and their references, are incorporated by reference herein where appropriate for teaching additional or alternative details, features, and/or technical background.

For a general understanding of the present invention, reference is made to the drawings. In the drawings, like reference numerals have been used throughout to designate identical elements.

While the present invention will be described hereinafter in connection with a preferred embodiment thereof, it should be understood that it is not intended to limit the invention to that embodiment. On the contrary, it is intended to cover all alternatives, modifications and equivalents as may be included within the spirit and scope of the invention as defined in the appended claims.

Figure 3:
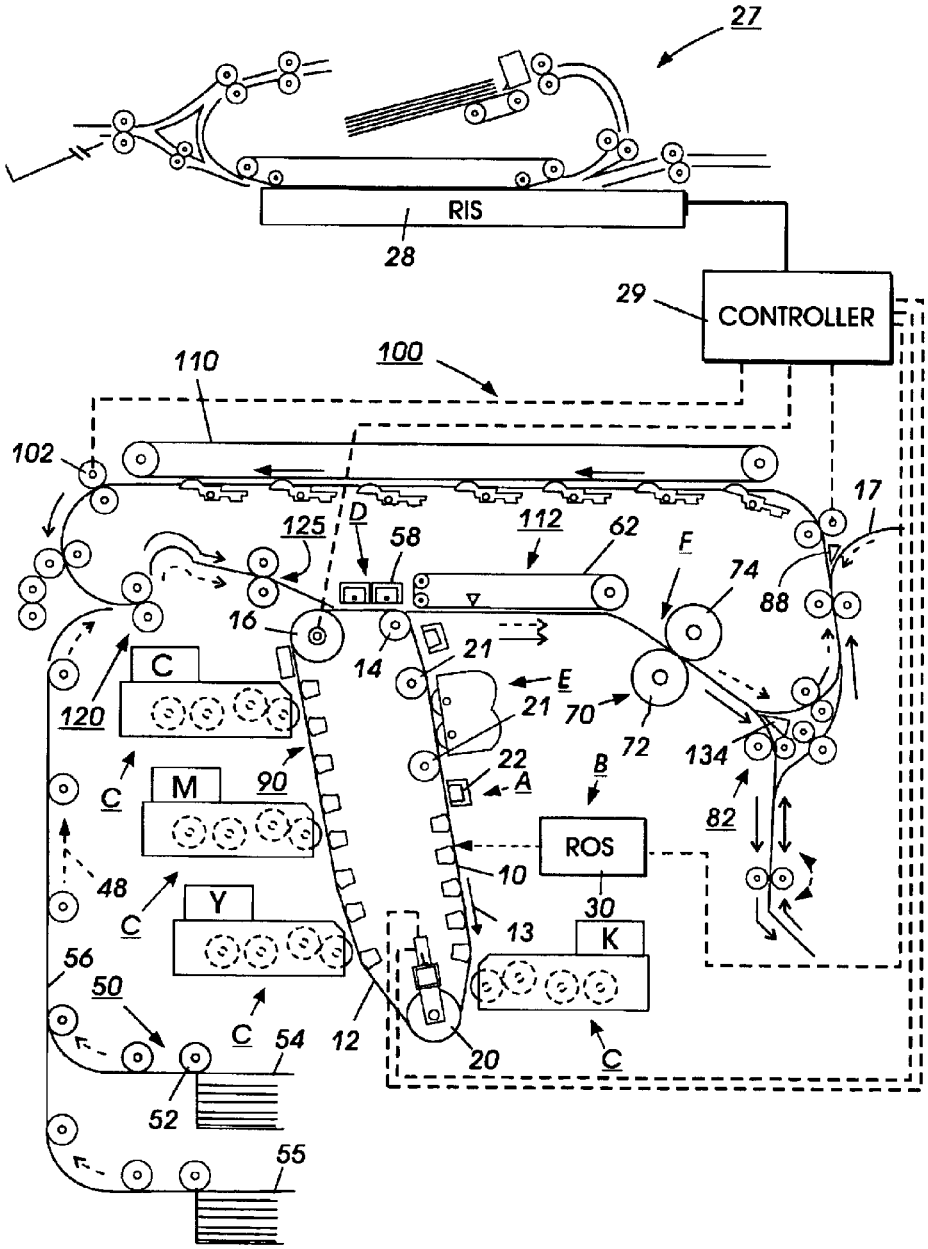
FIG. 3 is a schematic elevational view depicting web guide members of the present invention used as backer bars in a printing system.

FIG. 3 sets forth a more detailed description of on embodiment of an imaging system that utilizes web guide members to guide and position flexible imaging members. In the drawings, like reference numerals have been used through out to identify identical elements. FIG. 3 schematically illustrates an electrophotographic printing machine which generally employs a photoconductive belt 10 mounted on a belt support module 90. Preferably, the photoconductive belt 10 is made from a photoconductive material coated on a ground layer which, in turn, is coated on an anti-curl backing layer. Belt 10 moves in the direction of arrow 13 to advance successive portions sequentially through the various processing stations disposed about the path of movement thereof. Belt 10 is entrained about stripping belt 14, drive roll 16, idler roll 21, and tensioning steering roll 20. As roll 16 rotates, it advances belt 10 in the direction of arrow 13.

Initially, a portion of the photoconductive belt surface passes through charging station A. At charging station A, a corona generating device indicated generally by the reference numeral 22 charges the photoconductive belt 10 to a relatively high, substantially uniform potential.

At an exposure station B, a controller or electronic subsystem (ESS), indicated generally be reference numeral 29, receives the image signals from RIS 28 representing the desired output image and processes these signals to convert them to a continuous tone or greyscale rendition of the image which is transmitted to a modulated output generator, for example the raster output scanner (ROS), indicated generally by reference numeral 30. Preferably, ESS 29 is a self-contained, dedicated microcomputer. The image signals transmitted to ESS 29 may originate from RIS 28 as described above or from a computer, thereby enabling the electrophotographic printing machine to serve as a remotely located printer for one or more computers. Alternatively, the printer may serve as a dedicated printer for a high-speed computer. The signals from ESS 29, corresponding to the continuous tone image desired to be reproduced by the printing machine, are transmitted to ROS 30. ROS 30 includes a laser with rotating polygon mirror blocks. Preferably a nine-facet polygon is used. The ROS 30 illuminates the charged portion on the surface of photoconductive belt 10 at a resolution of about 300 or more pixels per inch. The ROS will expose the photoconductive belt 10 to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis.

After the electrostatic latent image has been recorded on photoconductive surface 12, belt 10 advances the latent image to a development station C, which includes four developer units containing C-Y-M-K color toners, in the form of liquid or dry particles, is electrostatically attracted to the latent image using commonly known techniques. The latent image attracts toner particles from the carrier granules forming a toner powder image thereon. As successive electrostatic latent images are developed, toner particles are depleted from the developer material. A toner particle dispenser, indicated generally by the reference numeral 44, dispenses toner particles into developer housing 46 of developer unit 38.

With continued reference to FIG. 3, after the electrostatic latent image is developed, the toner powder image present on belt 10 advances to transfer station D. A print sheet 48 is advanced to the transfer station D, by a sheet feeding apparatus 50. Preferably, sheet feeding apparatus 50 includes a feed roll 52 contacting the uppermost sheet of stack 54. Feed roll 52 rotates to advance the uppermost sheet from stack 54 to vertical transport 56. Vertical transport 56 directs the advancing sheet 48 of support material into registration transport 57 past image transfer station D to receive an image from photoreceptor belt 10 in a timed sequence so that the toner powder image formed thereon contacts the advancing sheet 48 at transfer station D. Transfer station D includes a corona-generating device 58, which sprays ions onto the backside of sheet 48. This attracts the toner powder image from photoconductive surface 12 to sheet 48. After transfer, sheet 48 continues to move in the direction of arrow 60 by way of belt transport 62, which advances sheet 48 to fusing station F.

Fusing station F includes a fuser assembly indicated generally by the reference numeral 70 which permanently affixes the transferred toner power image to the copy sheet. Preferably, fuser assembly 70 includes a heated fuser roller 72 and a pressure roller 74 with the powder image on the copy sheet contacting fuser roller 72. The pressure roller is crammed against the fuser roller to provide the necessary pressure to fix the toner powder image to the copy sheet. The fuser roll is internally heated by a quartz lamp (not shown). Release agent, stored in a reservoir (not shown), is pumped to a metering roll (not shown). A trim blade (not shown) trims off the excess release agent. The release agent transfers to a donor roll (not shown) and then to the fuser roll 72.

The sheet then passes through fuser 70 where the image is permanently fixed or fused to the sheet. After passing through fuser 70, a gate either allows the sheet to move directly via output 17 to a finisher or stacker, or deflects the sheet into the duplex path 100, specifically, first into single sheet inverter 82 here. That is, if the second sheet is either a simplex sheet, or a completed duplexed sheet having both side one and side two images formed thereon, the sheet will be conveyed via gate 88 directly to output 17. However, if the sheet is being duplexed and is then only printed with a side one image, the gate 88 will be positioned to deflect that sheet into the inverter 82 and into the duplex loop path 100, where that sheet will be inverted and then fed to acceleration nip 102 and belt transports 110, for recirculation back through transfer station D and fuser 70 for receiving and permanently fixing the side two image to the backside of that duplex sheet, before it exits via exit path 17.

After the print sheet is separated from photoconductive surface 12 of belt 10, the residual toner/developer and paper fiber particles adhering to photoconductive surface 12 are removed therefrom at cleaning station E. Cleaning station E includes a rotatably mounted fibrous brush in contact with photoconductive surface 12 to disturb and remove paper fibers and a cleaning blade to remove the nontransfered toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

Controller 29 regulates the various machine functions. The controller is preferably a programmable microprocessor, which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the document and the copy sheets.

Figure 4:
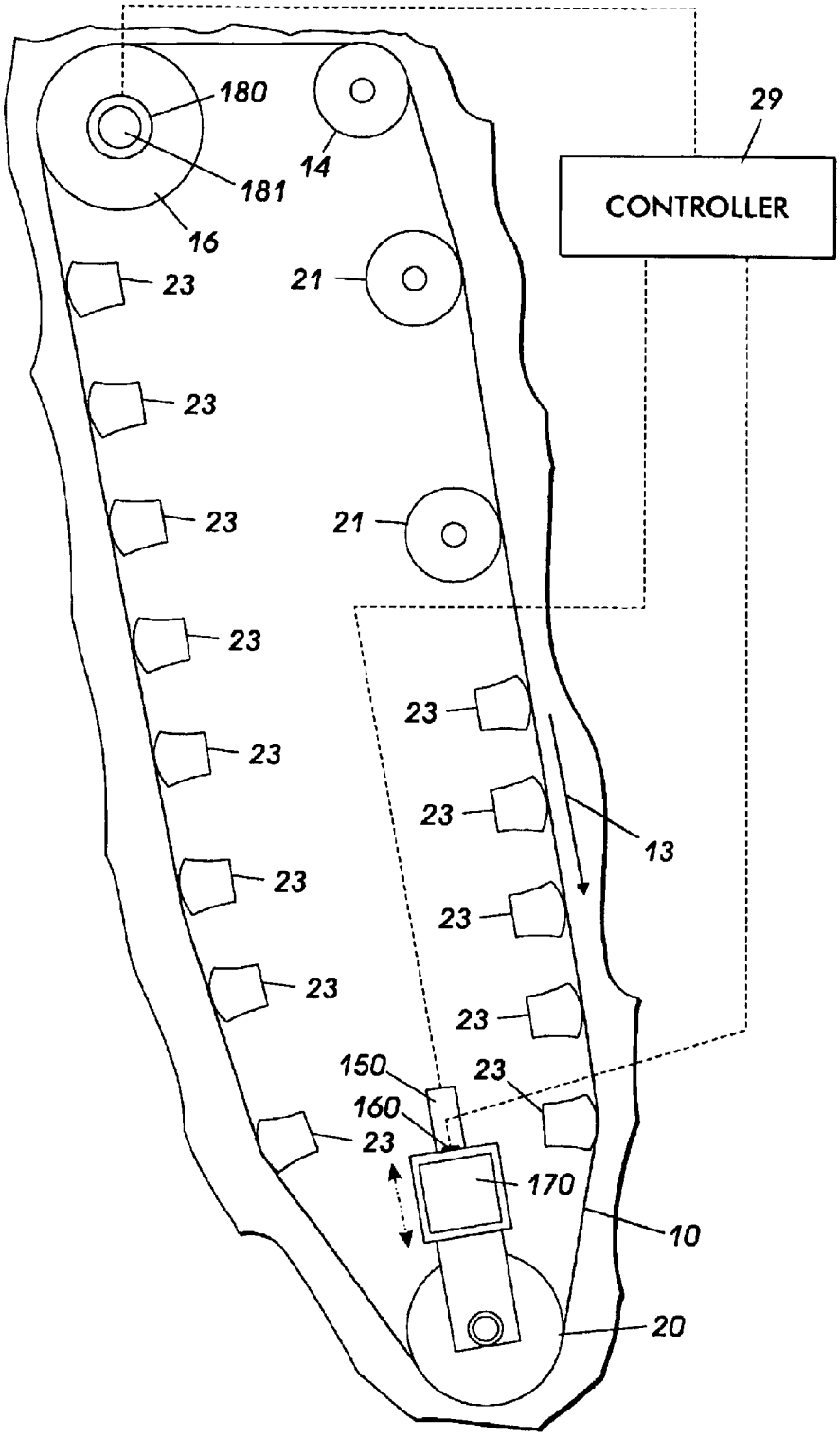
FIG. 4 is an expanded schematic elevational view of a photoreceptor belt held in tension with the aid of web guide members of the present invention.

More details concerning the function and importance of web guide members such as, backer bars are shown by reference to FIG. 4. In FIG. 4, a photoreceptor belt 10 is shown in a tensioned image receiving position as it is entrained around drive roll 16, tension steering roll 20, idler rolls 21, and stripping roll 14. Various sized backer bars 23 are stationary and serve to position and guide belt 10. A controller 29 controls actuation of stepper motor 150 in order to precisely tension photoreceptor belt 10 into a run or image receiving position. Controller 29 has been programmed to apply a predetermined tension standard amount against tension roll 20 and thus against photoreceptor belt 10. A strain gauge 160 is positioned on housing portion of yoke 170 and measures the tension applied against photoreceptor belt 10. Stepper motor 150 is actuated by controller 29 to apply tension yoke 170 or relieve tension from the yoke depending on whether tension on photoreceptor belt 10 is to be increased or decreased.

In operation, a predetermined amount of tension is placed on photoreceptor belt 10 through the actuation of stepper motor 150. Stepper motor 150 applies tension to photoreceptor belt 10 through pressure on yoke 170. Strain gauge 160 measures the pressure on photoreceptor belt 10 and signals controller 29 to stop the stepper motor. If the pressure on photoreceptor 10 measured by strain gauge 160 decreases a signal is sent to controller 29 which in turn actuates the stepper motor until strain gauge 160 reaches the predetermined pressure setting.

A sensor 180 is positioned on shaft 181 of drive roll 16 and monitors the rotation of the shaft. When photoreceptor belt 10 runs it experiences changes in drag of the belt on backer bars 23. If the drag of the belt on the backer bars becomes too large, drive roll 16 does not have enough friction to drive the belt creating a machine failure. The drag of photoreceptor belt 10 is monitored by sensor 180, and when it exceeds a safe limit, a signal from sensor 180 is sent to the controller which in turn actuates stepper motor 150 to slightly raise the tension on the belt which will develop enough drive friction to allow the printer to continue to run. In order to maintain belt 10 precisely in its intended track, steering roll 20 is positioned by a conventional stepping motor driving a rack and pinion through gate (not shown). This ability to steer belt 10 is indicated by the dotted lines showing variable positions of steering roll 20.

Throughout the above description, it should be clear that tolerances surrounding flexible belt 10 are maintained only if backer bars are shaped, positioned, and aligned extremely precisely. This precision is especially required for those backer bars that position belt 10 as it moves proximately to development station C. A description of the precision in this region is set forth in U.S. Pat. No. 5,491,538, hereby incorporated herein entirely by reference. In summary, web guide members such as, backer bars are one of three critical components controlling the tolerances in development station C since they control ⅓ of the variability in the development gap between the apparatus that donates toner and belt 10 that receives the toner. Quality imaging onto belt 10 requires that the entire development gap be enveloped within a cloud of toner emanating from the rolls or other apparatus that donate toner. Any non-uniformity in donor rolls (or other donating surfaces), belt 10, and web guide members 23 creates variability in the development zone within development station C. Even minor variations in the thickness of belt 10 across its width may substantially affect the consistency of toner transfer and, therefore, image quality. Accordingly, each web guide member 23 within the development zone of development station C must be extremely straight, smooth, aligned, and positioned correctly.

One embodiment of the novel process of manufacturing web guide members of the present invention involves the following intermediate processes: extruding a tube; turning the tube; parting the tube in arc segments; finishing; machining; and anodizing. Each parted arc segment becomes a web guide member 23. One embodiment of the novel processes of the present invention will now be further described below.

Figure 5:
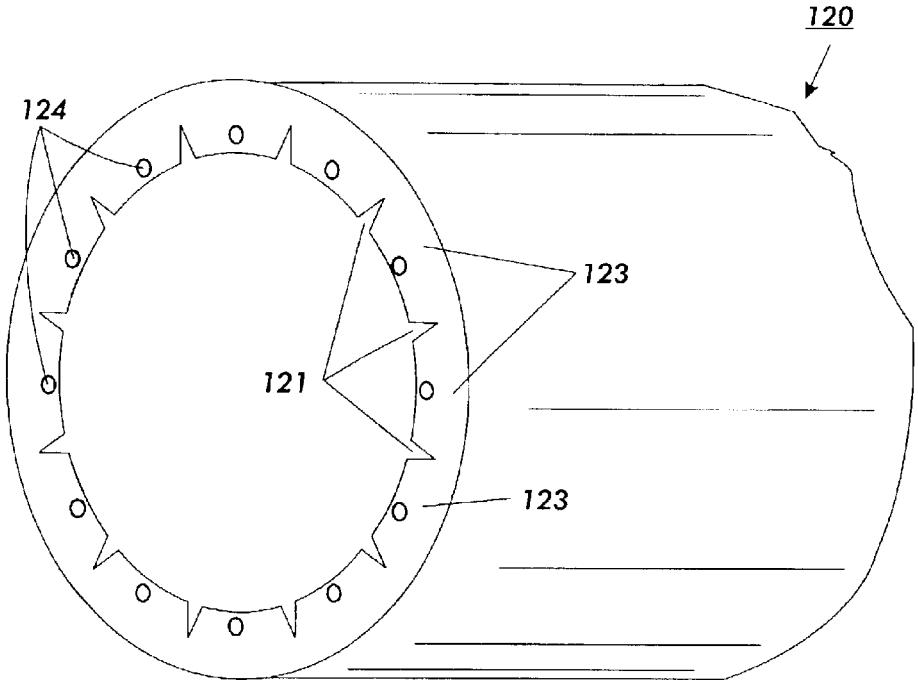
FIG. 5 is an elevated perspective view of an extruded tube from which web guide members of the present invention are formed.

Extruding. FIG. 5 shows an elevated perspective view of a portion of one embodiment of an aluminum alloy tube extruded using one embodiment of processes of the present invention. As shown in FIG. 5, the extrusion is in the shape of a round tube 120 with a series of internal spoke-like radial cavities labeled 121. Each radial cavity 121 is aligned along a radius of the cross-sectional profile. Any number of radial cavities 121 is possible depending upon the size of the tube and the number of web guide members expected to by yielded. 114 radial cavities are a common embodiment. Usually, each of the radial cavities is equidistantly spaced apart. As shown in relation to FIGS. 6 and 7, each radial cavity 121 forms the divide between arc segments of tube 120. Also, future machining may be aided if at least some spokes align along a diameter line bisecting tube 120. In one embodiment, radial cavities 121 are formed during extrusion a radial distance from the center of tube 120 that exceeds the outside diameter of tube 120 once it is turned in the turning process described below.

Figure 7:
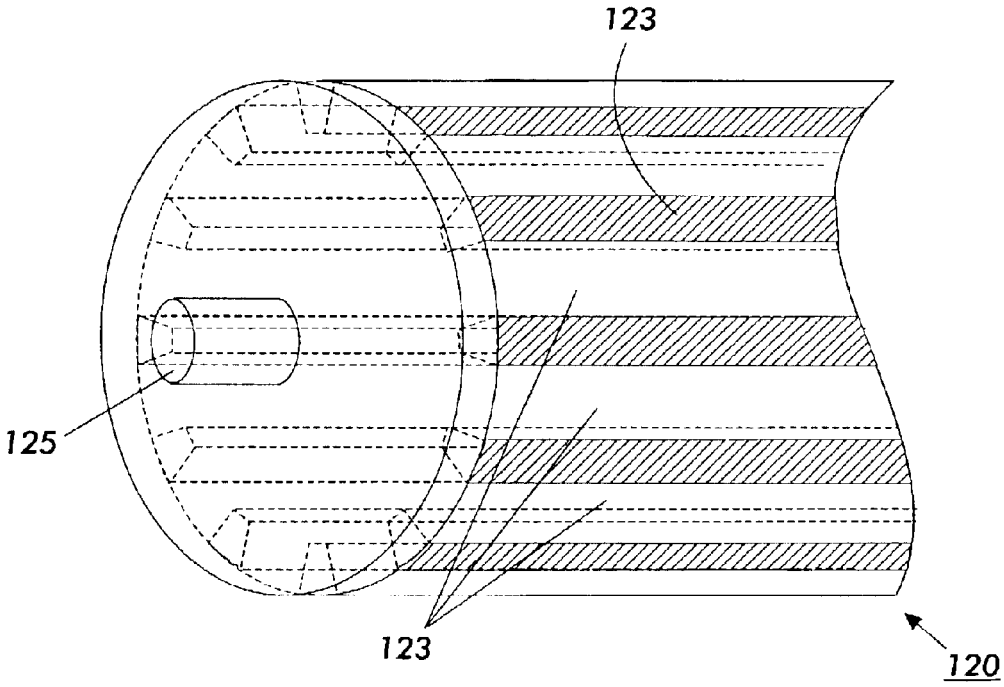
FIG. 7 is an elevated perspective view of a turned tube of the present invention after web guide members have been parted.

Machining/Drilling/Tapping. In alternative embodiments, tube 120 may be milled to final length prior to turning or may remain at an unfinished length. In the embodiment in which radial cavities 121 extend through the eventual outside diameter of tube 120, then a series of holes 124 are drilled and tapped into the ends of tube 120. These holes are for mounting tube 120 to faceplate fixtures as shown in FIG. 7. Such drilling and tapping may also occur even if radial cavities 121 do not extend beyond the eventual outside diameter, especially if a faceplate such as shown in FIG. 7 is used during turning.

Figure 6:
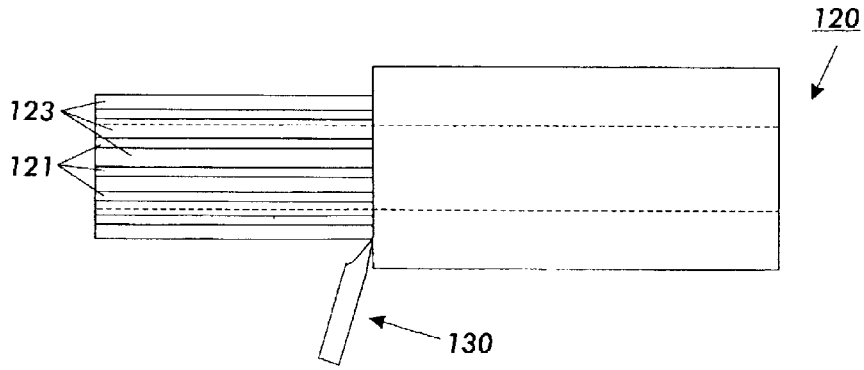
FIG. 6 is an elevational schematic view of a turning process of the present invention used in manufacture of the web guide members of the present invention.

Turning. FIG. 6 is an elevated schematic view of a turning process in which extruded tube 120 is turned in a suitable lathe (represented schematically by tool 130) to the desired size. For web guide members with a radius of 100.00 mm, the tube is turned to an outside diameter of 200.00 mm. A tube of this radius suffices for approximately 14 web guide members when finished. In the embodiment in which radial cavities 121 exceed the outside diameter of turned tube 120, it is anticipated that each radial cavity 121 may have a radius length 101 mm. When tube 120 is turned to a diameter of 200.00 mm, radial cavities 121 become exposed, thereby parting each of the arc segments 123 into shaped parts that can be finished into guide member bars 23.

Finishing. FIG. 7 shows turned tube 120 with parted web guide members 123 still mounted in mounting fixture 125 after being turned in lathe 130. While is still mounted within the turning lathe 130, the outside surface of web guide members 123 are smoothed and finished using standard turning tools such as, steel and carbide inserts or a grinding process using wheels.

Machining. In the embodiment described above in which parting occurs during the turning process, no further machining may be necessary if the end faces of tube 120 had been milled to length and holes 124 were in correct number and position on each arc segment 123 to be used when finally mounting web guide members 123 in final position within the imaging apparatus as shown in FIG. 3. Alternatively, the end faces of guide members 123 are milled to length after turning, and new holds are drilled and tapped in proper position and number for final guide member bars 123.

Figure 8:
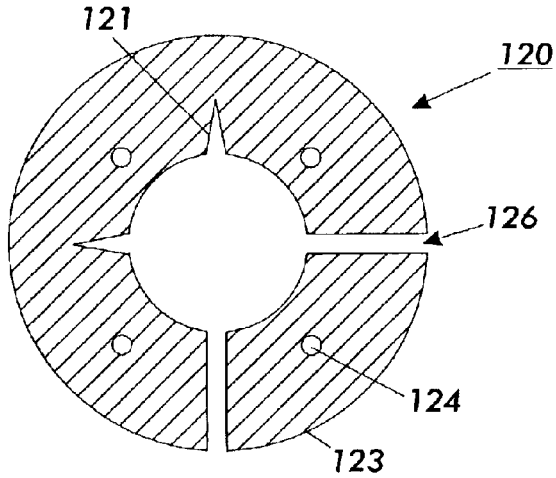
FIG. 8 is a cross-sectional view of an end section of a turned tube of one embodiment of the present invention.

In an alternative embodiment, radial cavities 121 do not extend through tube 120 to the outside diameter to which tube 120 will eventually be turned. In this embodiment, tube 120 remains intact during and after the turning process. Milling to proper length may occur before or after the turning process, and drilling and tapping holes 124 may similarly occur before or after the turning process. Whichever sequence is followed, turned tube 120 is mounted in fixture similar to faceplate fixture 125 and is mounted in a horizontal mill using the faceplates to hold the assembly. Once mounted in the mill, the separate web guide members 23 within the extrusion 120 are parted through a routing operation. As shown in FIG. 8, routing cuts 126 in this embodiment are aligned with radial cavities 121.

Anodizing. Once parted, the separated web guide members are completed by a standard anodizing process. Other coating methods and materials can also be used as needed. An example would be deposition coat of diamond like materials.

As described above, a number of important advantages result from the described embodiment of the present invention. First, the opportunity for error in the straightness of web guide members 123 is reduced essentially by 50 percent. This is because in prior art processes, as explained above, the longitudinal straightness of top radius surface 111 is determined by the straightness of the bottom surface, since this bottom surface determines the straightness of the web guide member within the cylindrical grinding mounting fixture. In contrast, only the top radius surface 111 of web guide members of the present invention need to be machined, and these are machined using a precision turning process rather than cylindrical grinding. Longitudinal straightness, therefore, is affected by precision machining of only one surface rather than two. It should be noted that whether web guide members 123 are made by the prior art process or the process of the present invention, the bottom surface is not essential to alignment of the web guide member within the electrophotographic printer or other web control device. Such mounting within the final apparatus is accomplished using fixtures attached to web guide members 123, typically using drilled and tapped holes 124. In doing so, the straightness or roughness of the bottom surface does not matter. Indeed, the bottom surface 112 of web guide members 123 of the present invention may remain round in conformance with the inside diameter of the original tube extrusion.

A second advantage of the web guide members and processes of the present invention is a significantly lower cost of producing web guide members 123. Specifically, the precision machining process of the prior art requires at least two surfaces to be precision machined along their full length in a linear milling process. Worse, such machining manufactures essentially one web guide member at a time. In contrast, one embodiment of the process of the present invention allows the top radius surface of many web guide members to be shaped, sized and finished using a simple turning process and length machining process. Instead of manufacture of one web guide member at a time and each web guide member requiring two precision machining processes, the present invention enables four, fourteen or more web guide members to be turned and finished at the same time. The top radius surface is the only surface requiring a precision surface, and the turning operation provides at least as much accuracy as a single linear machining process used in the prior art.

It should now be apparent that an improved web guide member and an improved process for making the same has been disclosed that lowers the cost and increases the precision required of web guide members used in web transport systems requiring precise tolerances. Such web systems are exemplified by electrophotographic imaging systems of the type described above.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

What is claimed is:

1. A process for manufacturing precision web guide members, comprising:

a) extruding a tube having a tubular body, a length dimension, an outside diameter, and an inside surface, said inside surface having radial cavities extending along the length dimension from the inside surface partially through the tubular body;

b) turning the tube to decrease the outside diameter; and c) sizing the tube to a desired length.

2. The process of claim 1, further comprising decreasing the outside diameter during turning sufficiently to intersect the internal radial cavities, thereby effecting a parting of web guide members.

3. The process of claim 1, wherein no intersection between the outside diameter and a radial cavity occurs during turning; and further comprising parting the tube at the radial cavities into separate web guide members.

4. The process of claim 3, wherein the step of parting comprises routing.

5. The process of claim 1, further comprising anodizing the separated web guide members.

6. The process of claim 1, wherein the sized tube of desired length has an end section; and further comprising forming attachment features proximate to the end section.

7. The process of claim 6, wherein forming attachment features further comprises drilling at least one hole at the end section.

8. The process of claim 6, further comprising using the formed attachment features both to mount the tube during the turning step and when mounting the finished web guide members in an apparatus within which a web is moved.

9. The process of claim 1, wherein the turned tube has an outside surface; and further comprising finishing the outside surface of the turned tube while still mounted on a turning apparatus.

10. The process of claim 1, wherein extruding the radial cavities further comprises extruding a triangular cross-section with the base of the triangle proximate to the inside surface of the tube.

11. The process of claim 1, wherein extruding the radial cavities further comprises extruding at least 10 radial cavities.

12. The process of claim 1, wherein finishing of the inside surface of the tube is avoided.

13. The process of claim 1, wherein the sized desired length is the length of the finished web guide members; and wherein the step of sizing precedes the step of turning.

14. A precision partially cylindrical web guide member for guiding a moving web member in an apparatus within which the web is moved, said web guide member comprising:

a) a top surface for contacting the web comprising the outside surface of an arc segment of a cylindrical tube; and b) a bottom surface comprising the inside surface of the arc segment of the cylindrical tube wherein the top and bottom surfaces comprise arc segments of a tubular extrusion.

15. The precision web guide member of claim 14 wherein the bottom surface has a surface texture that is essentially the same texture as when the bottom surface was extruded.

16. The precision web guide member of claim 14, wherein the web guide comprises a parted arc segment of a tubular extrusion and wherein the bottom surface has essentially the same dimensions as when the web guide was first parted.

17. The precision web guide member of claim 14, further comprising at least one circumferential surface in addition to the top and bottom surfaces, wherein the additional surface is angled relative to the top and bottom surfaces along a radius line of the arc segment of a cylindrical tube.

18. The precision web guide member of claim 14, further comprising at least two circumferential surfaces in addition to the top and bottom surfaces and wherein only the top surface undergoes a machining process after formation of the additional circumferential surfaces.

19. The precision web guide member of claim 14, wherein the top surface is shaped by turning.

20. The precision guide member of claim 14, wherein the web guide has two ends and further comprises mounting features formed proximately to both ends for mounting the web guide in the web moving apparatus.

21. The precision web guide member of claim 20, wherein the mounting features comprises holes formed at each end.

22. The precision web guide member of claim 14, wherein the web guide comprises a backer bar in an electrophotographic imaging system.

23. The precision web guide member of claim 14, wherein the web guide member comprises an aluminum alloy.

24. An electrophotographic imaging system, comprising:

a) a partially cylindrical web guide member for guiding a moving web, said web guide member comprising:

a top surface for contacting the web comprising the outside surface of an arc segment of a cylindrical tube; and a bottom surface comprising the inside surface of the arc segment of the cylindrical tube;

wherein the top and bottom surfaces comprise arc segments of a tubular extrusion; and b) a fixture for mounting the web guide member within the electrophotographic imaging system.

25. The electrophotographic imaging system of claim 24, further comprising a development station proximate to which at least one web guide member is mounted.

* * * * *